US006752684B1

(12) United States Patent
Lee

(10) Patent No.: US 6,752,684 B1
(45) Date of Patent: Jun. 22, 2004

(54) RADIO CONTROLLED TOY VEHICLE WITH TRANSFORMING BODY

(76) Inventor: Jason C. Lee, 405 W. Valley View Rd., #15, Talent, OR (US) 97540

( * ) Notice: Subject to any disclaimer, the term of this patent is extended or adjusted under 35 U.S.C. 154(b) by 0 days.

(21) Appl. No.: 10/676,308

(22) Filed: Sep. 30, 2003

(51) Int. Cl.[7] ..... A63H 30/04

(52) U.S. Cl. ..... 446/456; 446/457; 446/437; 446/443; 446/454

(58) Field of Search ..... 446/437, 470, 446/457, 454, 456, 443, 431

(56) References Cited

U.S. PATENT DOCUMENTS

| | | | | | |
|---|---|---|---|---|---|
| 4,568,306 | A | * | 2/1986 | Martin | 446/437 |
| 5,374,213 | A | * | 12/1994 | Brovelli | 446/470 |
| 5,643,041 | A | * | 7/1997 | Mukaida | 446/456 |
| 5,667,420 | A | * | 9/1997 | Menow et al. | 446/433 |
| 5,752,871 | A | * | 5/1998 | Tsuzuki | 446/457 |
| 5,951,363 | A | | 9/1999 | Uetake | |
| 6,132,287 | A | * | 10/2000 | Kuralt et al. | 446/431 |
| 6,394,876 | B1 | * | 5/2002 | Ishimoto | 446/470 |
| 6,398,613 | B1 | * | 6/2002 | Rehkemper et al. | 446/457 |
| 6,475,059 | B1 | * | 11/2002 | Lee | 446/454 |
| 6,540,583 | B1 | * | 4/2003 | Hoeting et al. | 446/443 |

FOREIGN PATENT DOCUMENTS

| | | | | |
|---|---|---|---|---|
| DE | 3308861 | A1 * | 6/1984 | A63H/19/10 |
| GB | 2124094 | A * | 2/1984 | A63H/17/00 |

* cited by examiner

*Primary Examiner*—Derris H. Banks
*Assistant Examiner*—Urszula M Cegielnik
(74) *Attorney, Agent, or Firm*—Robert E. Howard

(57) ABSTRACT

A radio controlled toy vehicle that has the ability to transform from a compact (narrow wheel track) configuration to an expanded (wide wheel track) configuration. The toy vehicle includes at least one driving wheel. Left and right main transformation arms are attached to left and right chassis bodies. A transformation drive is adapted to cause the main transformation arms to move towards or away from each other when the transformation drive is actuated, thereby causing the left and right chassis bodies to move towards or away from each other.

14 Claims, 7 Drawing Sheets

Fig. 1
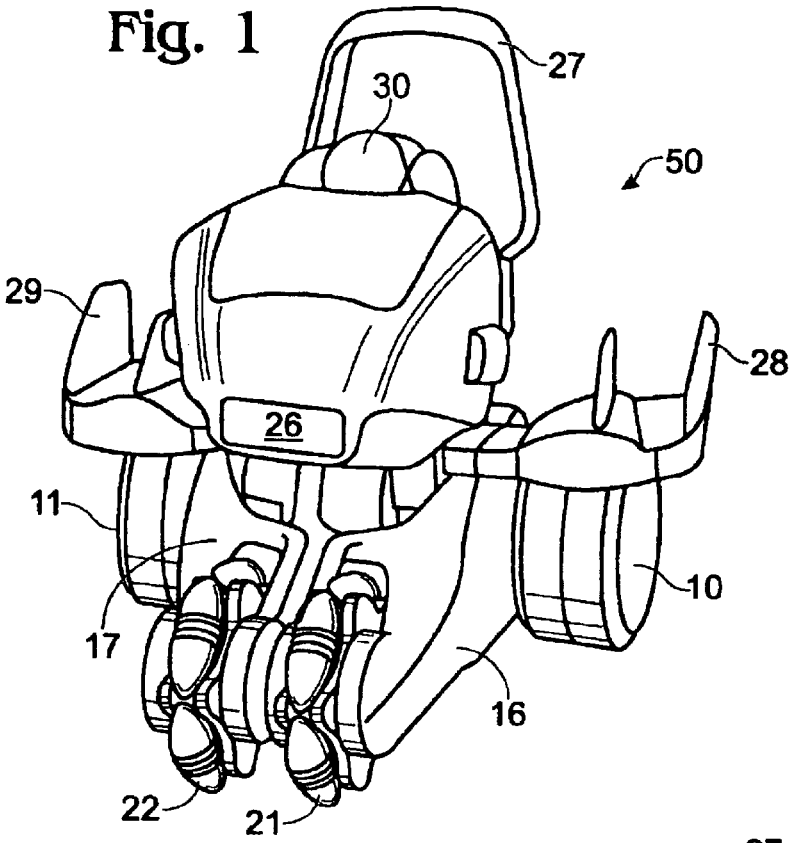
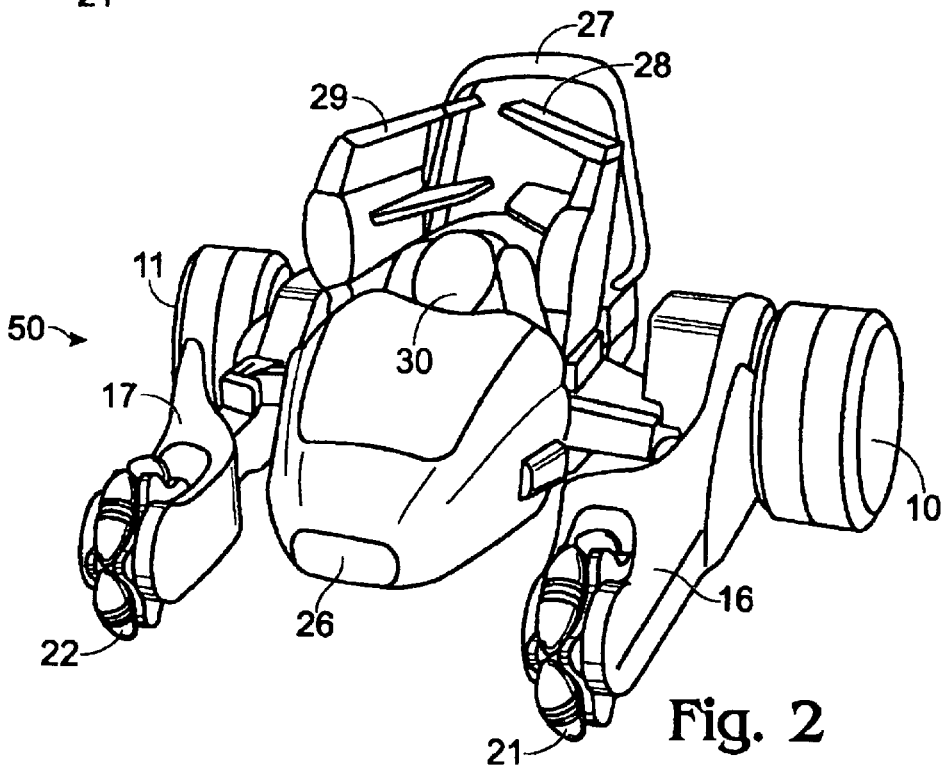
Fig. 2

RADIO CONTROLLED TOY VEHICLE WITH TRANSFORMING BODY

BACKGROUND OF THE INVENTION

The present invention relates to a radio controlled toy vehicle having a body that can be transformed from a compact operating mode to an expanded operating mode.

SUMMARY OF THE INVENTION

The radio controlled toy vehicle of the present invention has the ability to transform from a compact (narrow wheel track) configuration to an expanded (wide wheel track) configuration. Each configuration has unique performance abilities. The toy vehicle performance and capabilities dynamically changes during the transformation action, and are activated as directed by a radio control operator. The transformation action also activates a self-righting feature if the toy vehicle is disabled in an upside-down position.

The toy vehicle includes at least one driving wheel.

Left and right main transformation arms are attached to the left and right chassis bodies.

A transformation drive is adapted to cause the main transformation arms to move towards or away from the each other when the transformation drive is actuated to thereby cause the left and right chassis bodies to move towards or away from each other.

BRIEF DESCRIPTION OF THE DRAWINGS

FIG. 1 is a left front perspective view of the toy vehicle, shown in its compacted operating mode;

FIG. 2 is a left front perspective view of the toy vehicle, shown in its expanded operating mode;

BRIEF DESCRIPTION OF THE ELEMENTS

| | |
|---|---|
| 1. | Left rear wheel drive. |
| 2. | Right rear wheel drive. |
| 3. | Transformation drive. |
| 4. | Left main transformation arm. |
| 5. | Right main transformation arm. |
| 6. | Rear bushing wiring guide. |
| 7. | Main center pivot rod. |
| 8. | Radi receiver box. |
| 9. | Rear tilt wheel. |
| 10. | Left rear driving wheel. |
| 11. | Right rear driving wheel. |
| 12. | Left pivot pin. |
| 13. | Right pivot pin. |
| 14. | Left small transformation arm pivot pin. |
| 15. | Right small transformation arm pivot pin. |
| 16. | Left chassis body. |
| 17. | Right chassis body. |
| 18. | Battery compartment. |
| 19. | Left small transformation arm. |
| 20. | Right small transformation arm. |
| 21. | Left front sliding wheel. |
| 22. | Right front sliding wheel. |
| 23. | Left sliding wheel pivot pin. |
| 24. | Right sliding wheel pivot pin. |
| 25. | Front wire harness and pivot guide. |
| 26. | Nose. |
| 27. | Rear wing. |
| 28. | Left side wing. |
| 29. | Right side wing. |
| 30. | Body figure. |
| 31. | Center chassis body. |
| 32. | Battery |
| 33. | Battery cover latch. |
| 34. | Battery cover. |
| 35. | Driving surface. |
| 36. | General vehicle shape, front view. |
| 37. | Left wing tilt point. |
| 38. | Right wing tilt point. |
| 39. | Remote control transmitter. |
| 40. | Left main transformation arm, first alternative embodiment. |
| 41. | Right main transformation arm, first alternative embodiment. |
| 42. | Left small transformation arm, first alternative embodiment. |
| 43. | Right small transformation arm, first alternative embodiment. |
| 44. | Left sliding track, second alternative embodiment. |
| 45. | Right sliding track, second alternative embodiment. |
| 50. | Toy vehicle. |
| 100. | Left rear wheel drive motor. |
| 102. | Left rear wheel drive reduction gears. |
| 104. | Left rear wheel drive drive shaft. |
| 119. | Left small transformation arm gear. |
| 120. | Right small transformation arm gear. |
| 136. | General vehicle shape, top view. |
| 150. | First alternative embodiment of toy vehicle. |
| 200. | Right rear wheel drive motor. |
| 202. | Right rear wheel drive reduction gears. |
| 204. | Right rear wheel drive drive shaft. |
| 236. | General vehicle shape, side view. |
| 250. | Second alternative embodiment of toy vehicle. |
| 300. | Transformation drive motor. |
| 302. | Transformation drive reduction gears. |

DESCRIPTION OF PREFERRED EMBODIMENTS

FIG. 1 shows the toy vehicle 50 of the present invention in its compacted configuration, and FIG. 2 shows the toy vehicle 50 in its expanded configuration.

Figure 5:
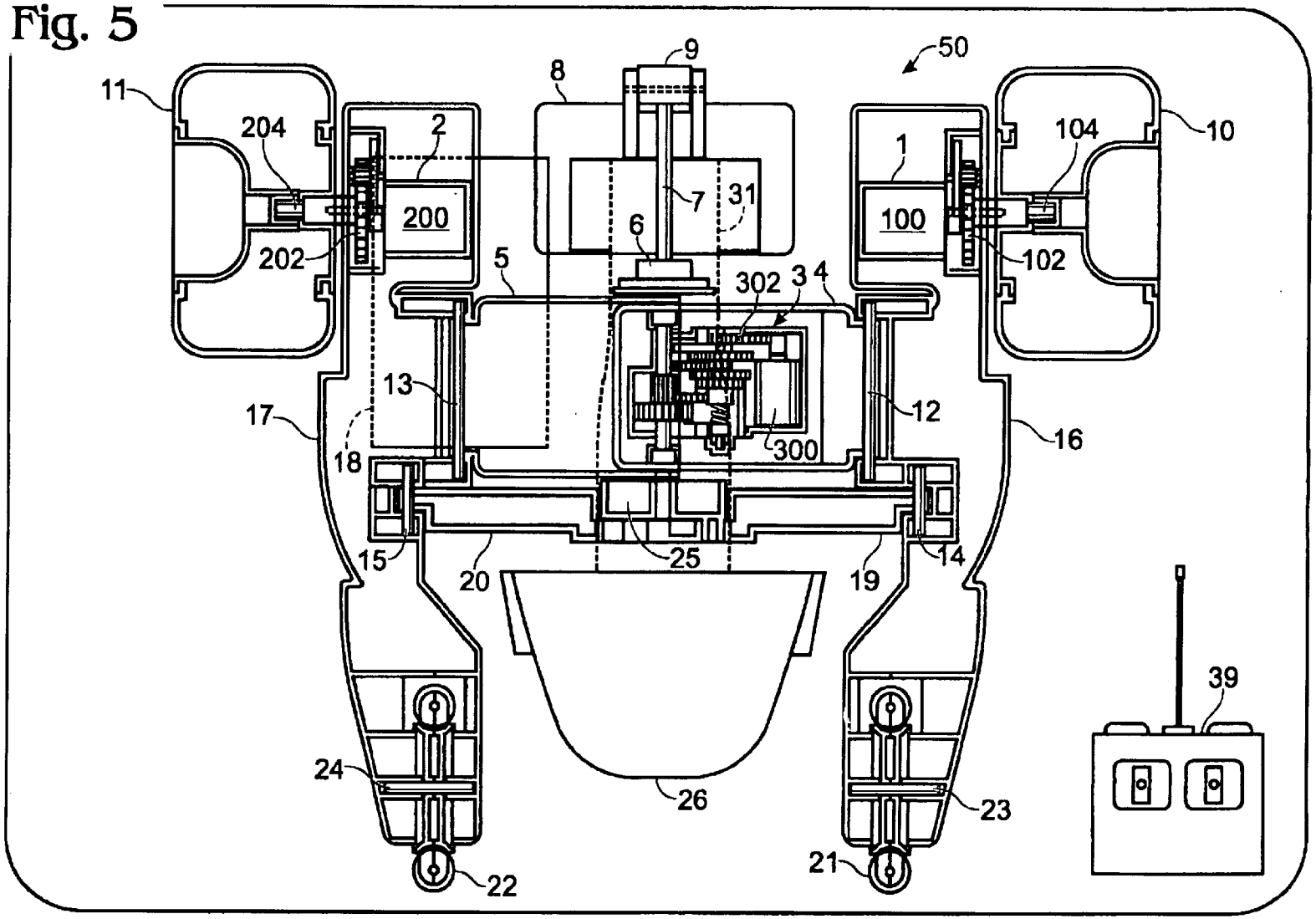
FIG. 5 is a top plan view in cross-section of the toy vehicle, shown in its expanded operating mode.

A top plan view of the toy vehicle 50 in its expanded configuration is shown in cross-section in FIG. 5. A center chassis body 31 is flanked by left chassis body 16 and right chassis body 17. Center chassis body 31 is mechanically fastened to radio receiver box 8, nose 26 and front wire harness pivot guide 25. A main center pivot rod 7 is pivotally mounted through front wire harness and pivot guide 25, rear bushing wiring guide 6, and radio receiver box 8.

A left main transformation arm 4 is a housing that is pivotally mounted to main center pivot rod 7 along fits inner edge and pivotally mounted to left pivot pin 12 along its outer edge. Pivot pin 12 is held by left chassis body 16.

A right main transformation arm 5 is concave (hollow), having a floor and sidewalls, and is adapted to receive left main transformation arm 4 therein when toy vehicle 50 is in its compacted position. Right main transformation arm 5 is mechanically interlocked to main center pivot rod 7 through ears extending from the inner edges of its sidewalls, and pivotally mounted to right pivot pin 13 along its outer edge. Pivot pin 13 is held by right chassis body 17.

A left small transformation arm 19 is pivotally attached to left small parallel pivot pin 14 on one end. Pivot pin 14 is held by left chassis body 16.

A right small transformation arm 20 is pivotally attached to right small parallel pin 15 on one end. Pin 15 is held by right chassis body 17. Left small transformation arm 19 is mechanically coupled to right small transformation arm 20 by means of integral gears 119 and 120 (FIG. 7) pivotally mounted to front wire harness pivot guide 25.

Figure 6:
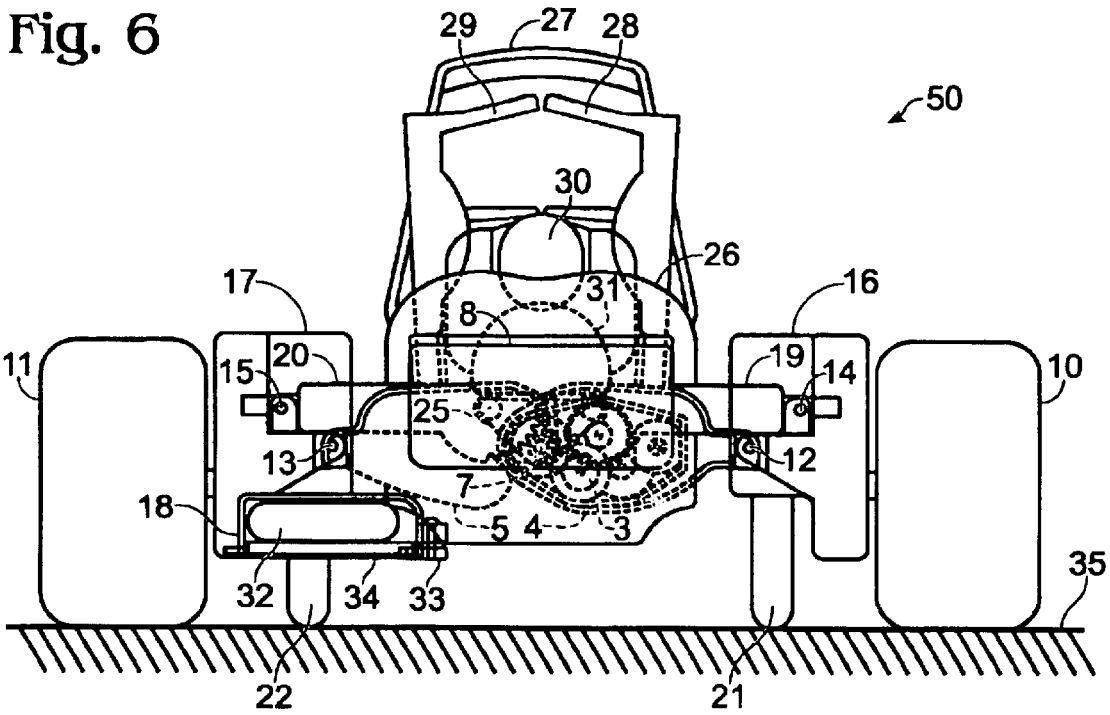
FIG. 6 is a front elevation view in cross-section of the toy vehicle, shown in its expanded operating mode.

A transformation drive 3 is shown in FIGS. 5 and 6. Transformation drive 3 is a known design comprising a reversible electric motor 300 driving high torque producing reduction gears 302 which are coupled to a torque-limiting clutch. An example of a suitable gearbox is one produced by Tamiya Inc. of Japan and called their "High Powered Gearbox". An example of a suitable clutch mechanism is described in U.S. Pat. No. 4,490,939 and U.S. Pat. No. 6,394,876.

Transformation drive 3 is mounted within right main transformation arm 4 and is drivingly coupled to main center pivot rod 7. Transformation drive 3 rotates right main transformation arm 4 towards or away from the concave body of the right main transformation arm 5. This action moves left chassis body 16 and right chassis body 17 closer to or away from each other while simultaneously raising or lowering center chassis body 31, respectively.

Left small transformation arm 19, right small, transformation arm 20 and main transformation arms 4 and 5 have equal pivot center to pivot center lengths that pivot along the same plane. Synchronized parallel action of the respective main and small transformation arms of the left and right sides keep the circular plane of the driving wheels 10 and 11 perpendicular to the driving surface 35 in both the compacted and expanded operating modes of the toy vehicle 50. This includes all modes between the two main operating modes. This configuration also allows the chassis bodies 16 and 17 to fit closely together in the compacted operating mode of the toy vehicle 50, as shown in FIGS. 1 and 7.

Center chassis body 31 is displaced above left and right chassis bodies 16 and 17 in the compacted operating mode, and is positioned therebetween in the expanded operating mode.

A rear wing 27 is mounted to the top of radio receiver box 8, which is mounted to the rear of the center chassis body 31. Body FIG. 30 is mounted on top of the center chassis body 31. Rear wing 27 and body FIG. 30 move vertically upward and downward with the upward and downward movement of center chassis body 31.

Figure 7:
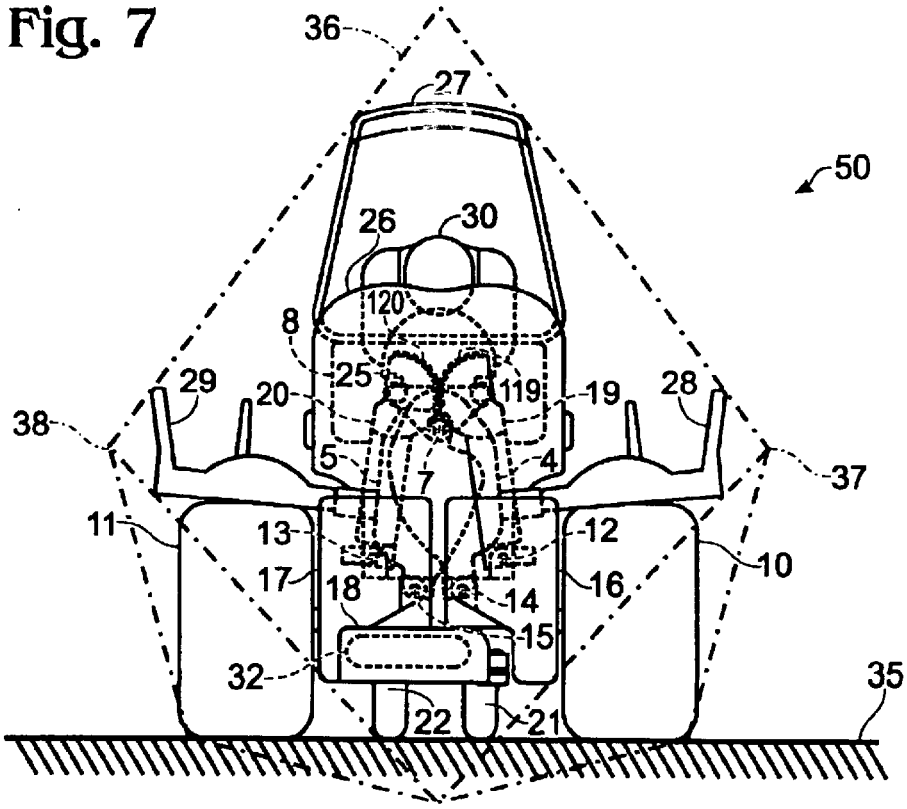
FIG. 7 is a front elevation view in cross-section of the toy vehicle, shown in its compacted operating mode.

Referring to FIG. 7, left side wing 28 is mounted to the top exterior surface of left main transformation arm 4. Right side wing 29 is mounted to the top exterior surface of right main transformation arm 5. Left and right side wings 28 and 29 each include a pair of winglets. When the toy vehicle 50 is in its compacted operating mode, left side wing 28 and right side wing 29 extend beyond the track width of the toy vehicle. Left side wing 28 and right side wing 29 create pivot points 37 and 38 at which the center of gravity of toy vehicle 50 is in the region of the rear wheels 10 and 11.

In FIG. 7, general front shape 36 represents the generally diamond shape of the toy vehicle 50, as seen in this front elevation view thereof, with the right and left wing tilt points 37 and 38 extending to the outermost edges of the sides of the toy vehicle. Rear wing 27 and the lower edges of left and right wheel 10 and 11 form the outer limits of the top and bottom of toy vehicle 50.

Figure 8:
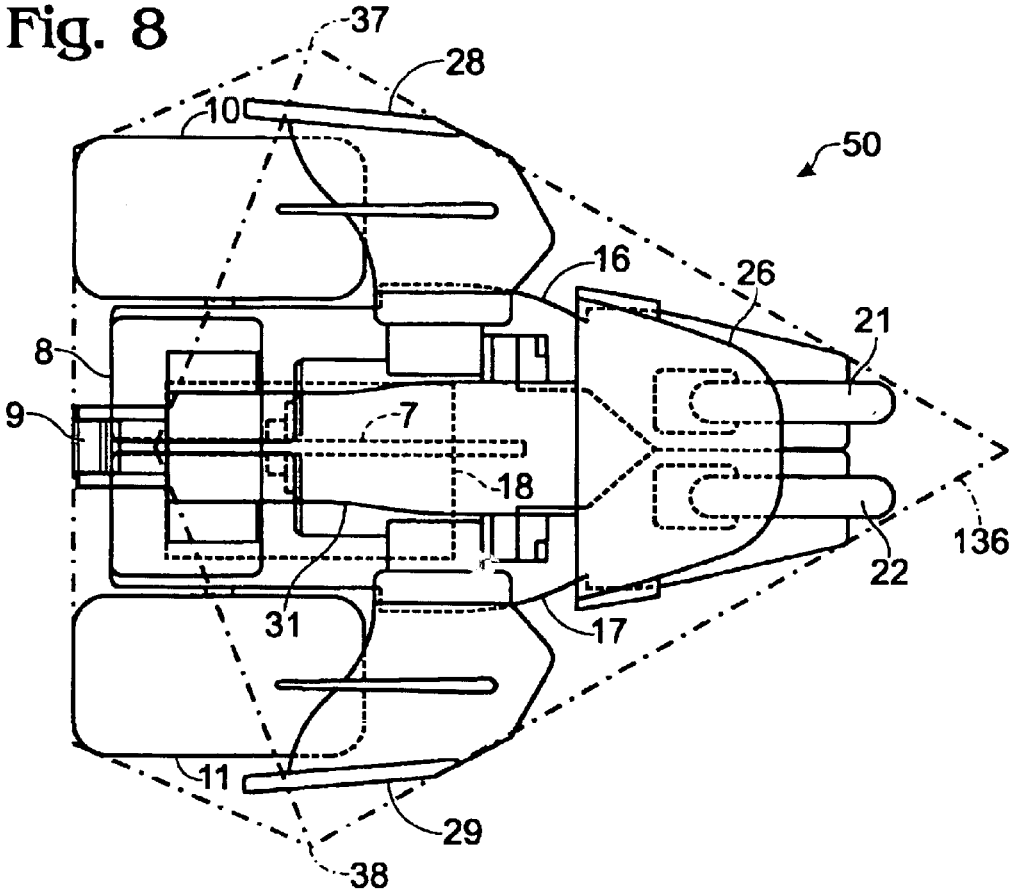
FIG. 8 is a top plan view of the toy vehicle, shown in its compacted operating mode.

In FIG. 8, general top shape 136 represents the generally diamond shape of the toy vehicle 50 as seen in a top plan view thereof, with the right and left wing tilt points 37 and 38 extending to the outermost edges of the sides of the toy vehicle. The rear outer edges of the left and right wheels 10 and 11 and the front outer edges of the left and right front sliding wheels 21 and 22 form the outer limits of the front and rear of toy vehicle 50.

Figure 3:
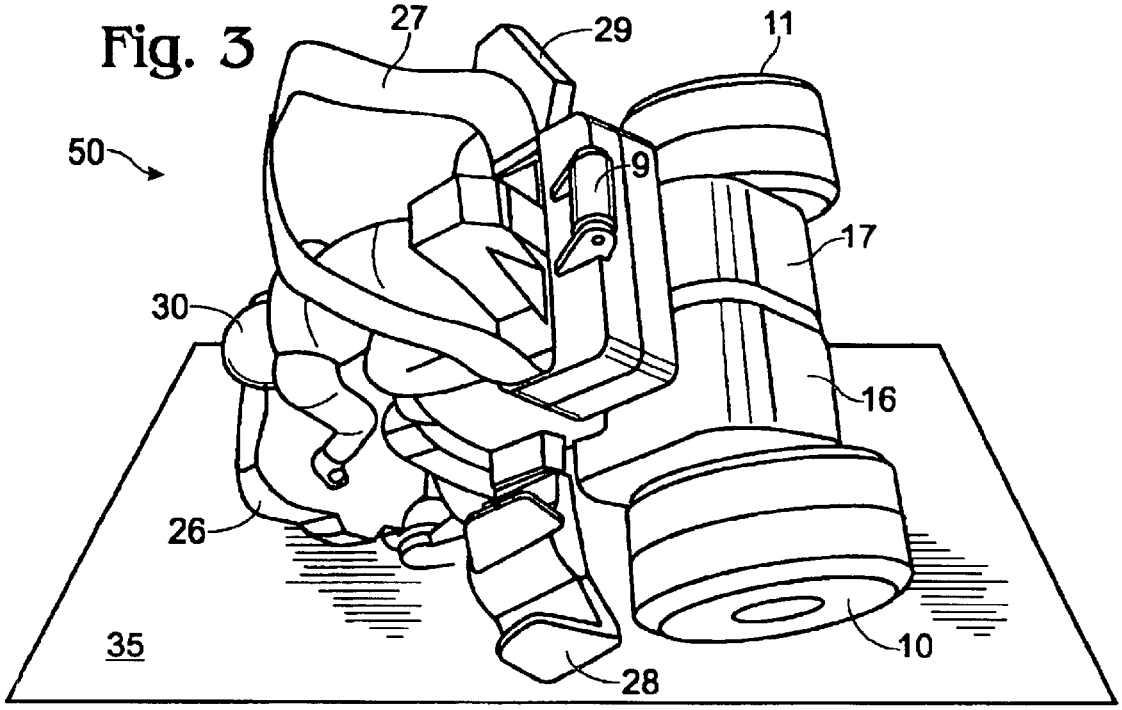
FIG. 3 is a left side perspective view of the toy vehicle shown in a self-righting position.
Figure 9:
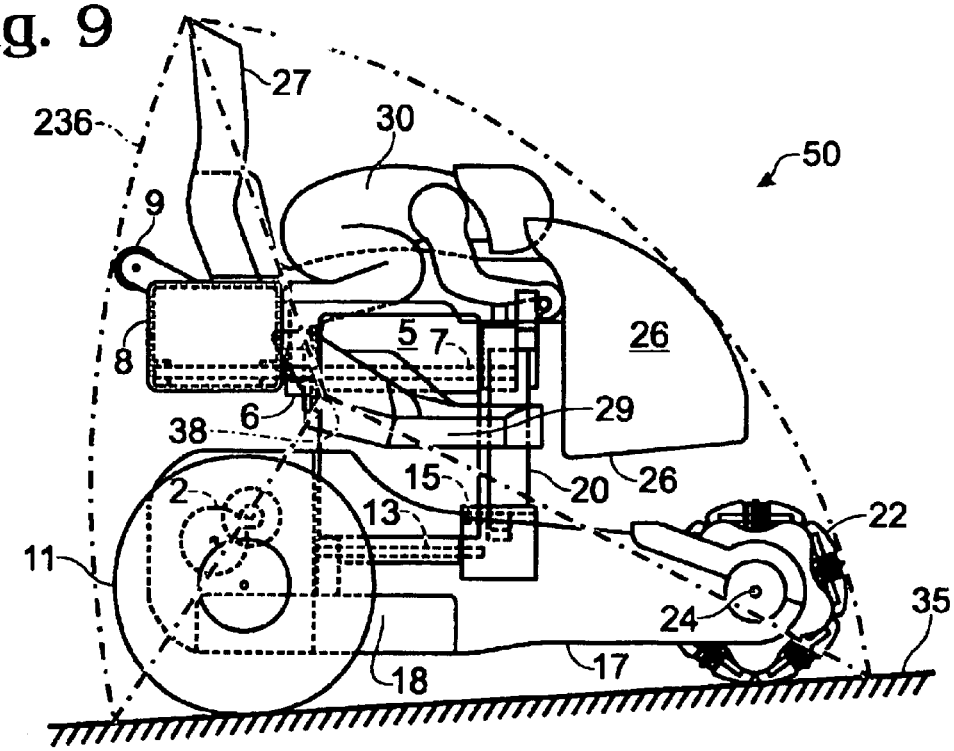
FIG. 9 is a right side elevation view of the toy vehicle, shown in its compacted operating mode.

In FIG. 9, general side shape 236 is essentially comprised of three planes that form an apex at the left and right wing tilt points 37 and 38. The center of gravity of the toy vehicle 50 is in the lower edge plane region closest to driving surface 35. This region encompasses the lower edges of driving wheels 10 and 11. As best seen in FIG. 3, when the toy vehicle 50 tumbles it will tilt toward the center of gravity and come to rest with at least one of the lower edge of driving wheels 10 or 11 in contact with the driving surface 35. Any force exerted by driving wheels 10 or 11 will cause the toy vehicle 50 to complete the tilting of the vehicle to the upright position.

When the toy vehicle 50 is in the expanded operating mode shown in FIGS. 2 and 6, right and left side wings 28 and 29 are folded vertically and neatly around body FIG. 30, and serve only as an aesthetic feature of the toy vehicle.

Referring now to FIG. 5, left drive 1 is comprised of a conventional reversible electric motor 100 coupled to a drive train that includes reduction gears 102 and drive shaft 104. Right drive 2 is comprised of a conventional reversible electric motor 200 coupled to a drive train that includes reduction gears 202 and drive shaft 204. Left drive 1 drives the left driving wheel 10 and identical right drive 2 drives the right driving wheel 11.

While in the preferred embodiment described there are two driven rear wheels 10 and 11, two driven front wheels could be substituted for non-driven left and right front sliding wheels 21 and 22 to provide a four wheel drive toy vehicle. Another alternative would be to provide a toy vehicle with just one driven wheel, but having the transforming bodies described herein. A further alternative would be to provide a single driven or non-driven front wheel in substitution of sliding wheels 21 and 22 to provide a tricycle pattern.

A conventional radio control receiver located in radio receiver box 8 receives control signals from a conventional radio control transmitter 39, and directs power to each motor 100, 200 or 300 as desired. Control switches on remote control transmitter 39 allow independent control of each drive wheel 10 and 11, and also control of transformation drive 3.

Power and control wiring travel from the radio receiver in radio receiver box 8 through rear bushing wiring guide 6, center chassis body 31, and connects to transformation drive 3. The wiring continues through to front wire harness pivot guide 25, small transformation arms 19 and 20, on to respective electric motors and gear drives 1 and 2, and to the battery 32 located in battery compartment 18. Additional wiring from battery 32 travels back in the opposite direction to the radio receiver in radio receiver box 8. A power switch (not shown) is mounted on radio receiver box 8 to connect and disconnect the battery.

Pressing one button on remote control transmitter 39 causes the toy vehicle 50 to expand, and pressing another button causes the toy vehicle to compact. Fully compacted and fully expanded are the two main operating modes for toy vehicle 50; however, operating modes between the two main operating modes can be selected.

A conventional torque sensitive clutch is located within the gear box of transformation drive 3 to prevent it from self-destructing as the toy vehicle 50 reaches the end of the transformation from one main operating mode to the other.

Toy vehicle 50 has the ability to turn left or right, forward and reverse. A left front sliding wheel 21 and a right front sliding wheel 22 are of a know design for an omnidirectional wheel. Sliding wheels 21 and 22 roll easily forward and reverse on pivot pins 23 and 24, and also slide sideways to easily spin in-place if left and right drive wheels 10 and 11 are commanded to spin in opposite directions.

Activating left drive 1 drives left driving wheel 10 either forward or reverse, and causes the toy vehicle 50 to turn right or left. Activating right drive 2 drives right driving wheel 11 either forward or reverse, and causes the toy vehicle 50 to turn right or left. Activating left and right drives 1 and 2 in the same direction drives the vehicle forward or in reverse. Activating the left and right drives 1 and 2 in opposing directions causes the toy vehicle 50 to spin or turn with increased speed.

The toy vehicle 50 has a narrower track width when the toy vehicle is in the compacted operating mode shown in FIG. 1 than when the toy vehicle is in the expanded operating mode shown in FIG. 2. Narrowing the track width serves to stabilize the toy vehicle 50 in the straight line direction due to the increase in proportion of the wheel base to the track width.

In the compacted operating mode the toy vehicle 50 turns more slowly, and in the expanded operating mode the toy vehicle turns more quickly.

Figure 4:
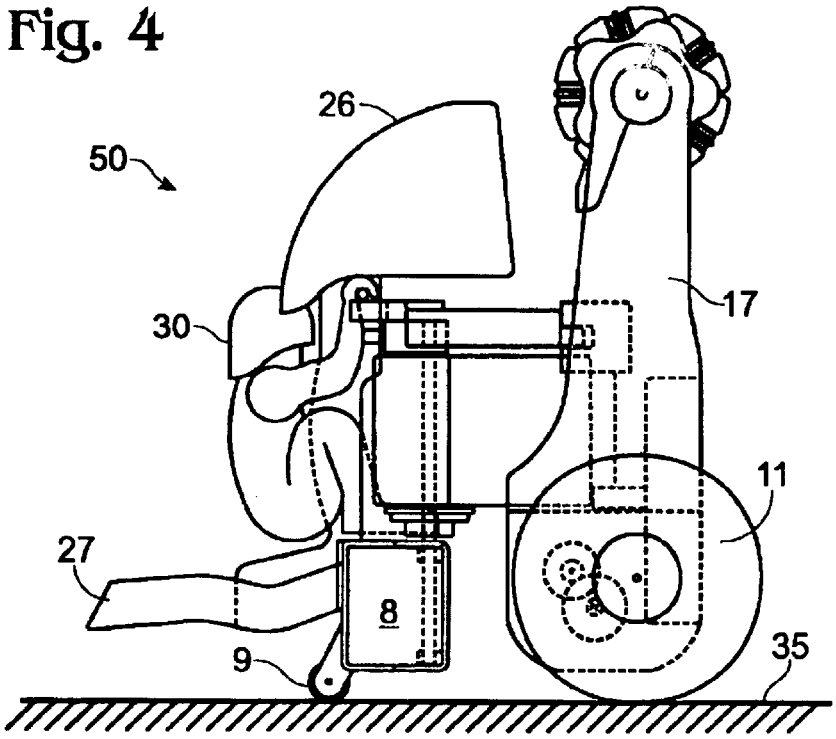
FIG. 4 is a right side elevation view of the toy vehicle shown in its upright operating mode.

In the compacted operating mode shown in FIG. 1 the toy vehicle 50 has a high center of gravity. In this mode the higher center of gravity allows the toy vehicle to operate in the alternate operating mode shown in FIG. 4. Due to the higher center of gravity, counter torque of the drive motors are able to tilt the vehicle up into this nose-up operating mode. Since both driving wheels 10 and 11 are still in contact with the driving surface 35, all steering functions are operable. A rear tilt wheel 9 allows the toy vehicle 50 to roll about on its tail-end easily in the nose-up position.

In the expanded operating mode shown in FIG. 2, the toy vehicle 50 has a lower center of gravity than that in its compacted operating mode. The toy vehicle's low center of gravity in this operating mode makes the toy vehicle extremely stable and suitable for high-speed maneuvers. In this operating mode the toy vehicle can become disabled during the course of driving, such as rolling over into an upside-down position. However, the toy vehicle can recover to an operable position (shown in FIG. 3) if the transformation function is activated and the toy vehicle is transformed into the compacted operating mode (shown in FIG. 1). In the compacted operating mode the toy vehicle is able to tilt back into the upright position.

Figure 10A:
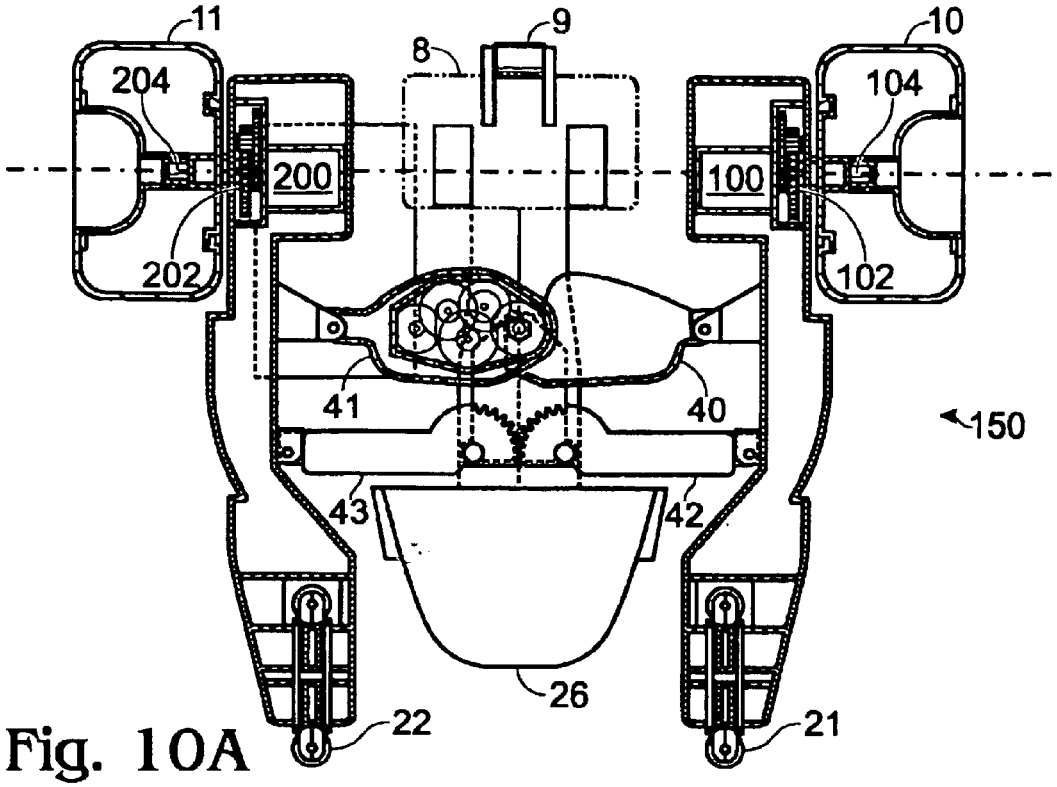
FIG. 10A is a top plan view in cross-section of a first alternative embodiment of the toy vehicle, shown in its expanded operating mode.
Figure 10B:
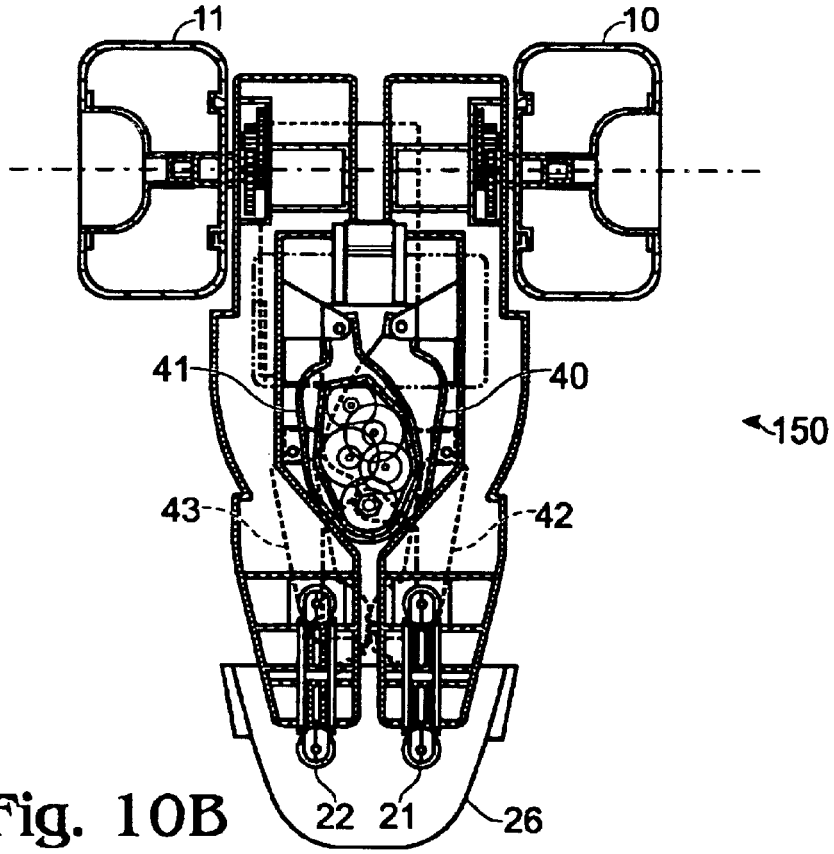
FIG. 10B is a top plan view in cross-section of the first alternative embodiment of the toy vehicle, shown in its compacted operating mode.
Figure 11A:
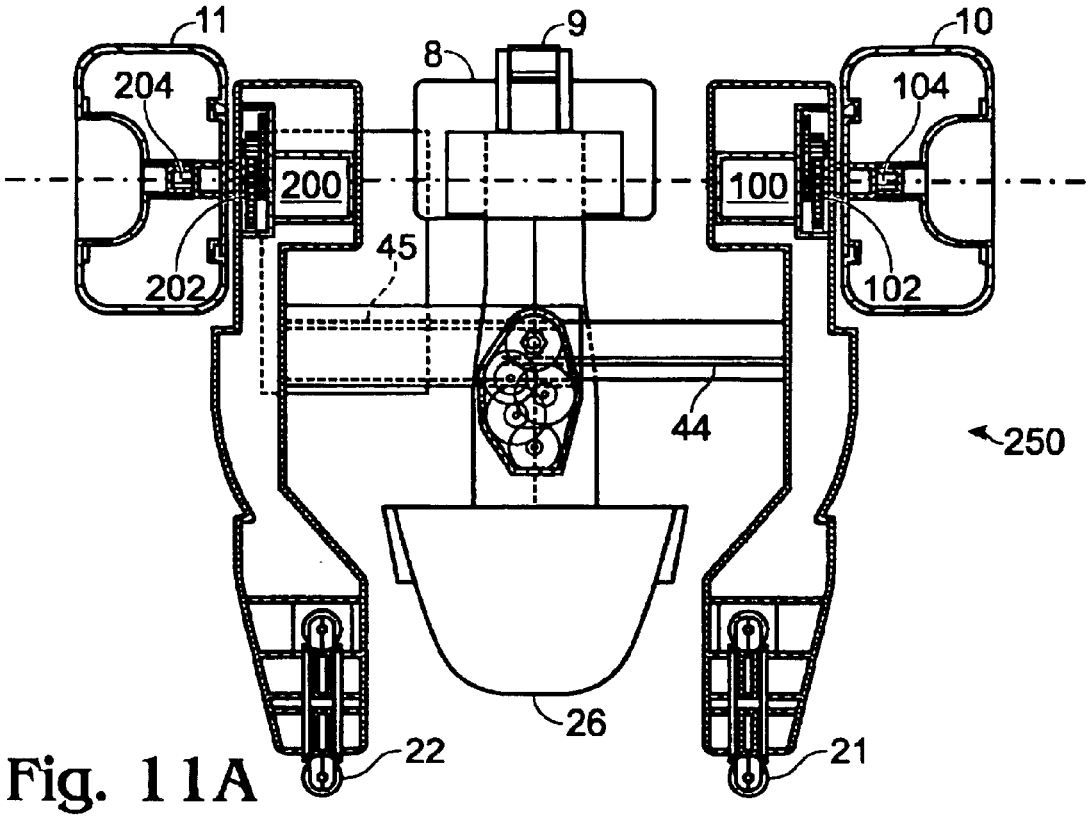
FIG. 11A is a top plan view in cross-section of a second alternative embodiment of the toy vehicle, shown in its expanded operating mode.
Figure 11B:
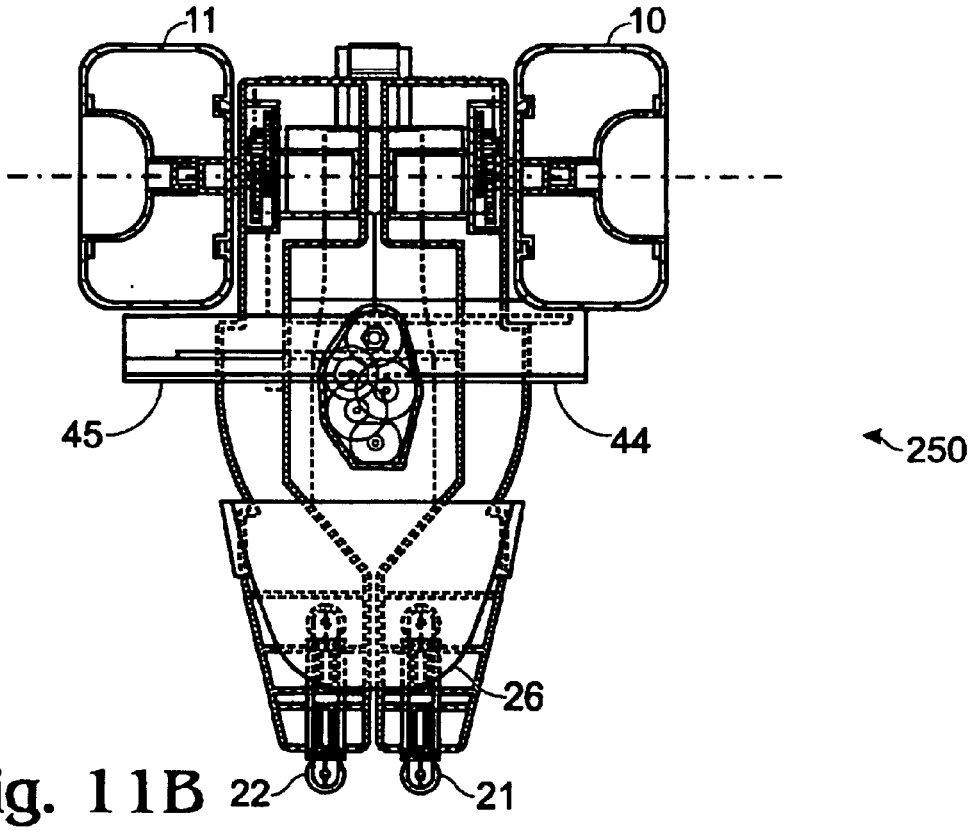
FIG. 11B is a top plan view in cross-section of the second alternative embodiment of the toy vehicle, shown in its compacted operating mode.

In the first alternative embodiment shown in FIGS. 10A and 10B, left and right main transformation arms 40 and 41 and left and right small transformation arms 42 and 43 operate in planes that are parallel to the driving surface. The remainder of the toy vehicle 150 remains the same as in the preferred embodiment 50 described above. FIG. 11A shows the toy vehicle 150 in the expanded operating mode, and FIG. 11B shows the toy vehicle 150 in the compacted operating mode. Whereas in the embodiment described in FIGS. 1–9 the toy vehicle 50 has an up and down transformation motion as well as a side to side transformation motion, in the first alternative embodiment shown in FIGS. 10A and 10B the toy vehicle 150 has a front to back transformation motion in addition to the side to side transformation motion. As the toy vehicle 150 contracts, its length increases, and vice versa.

In the second alternative embodiment shown in FIGS. 11A and 11B, a left main transformation arm 44 comprised of a sliding rack element and a right main transformation arm 45 comprised of a sliding track element are used as the transformation mechanism. One of the main transformation arms 44 or 45 can be driven through a rack and pinion gear system, or by means of a feed (jack) screw. The remainder of the toy vehicle 250 remains the same as in the preferred embodiment 50 described above. FIG. 11A shows the toy vehicle 250 in the expanded operating mode, and FIG. 11B shows the toy vehicle 250 in the compacted operating mode. Whereas in the embodiment described in FIGS. 1–9 the toy vehicle 50 has an up and down transformation motion as well as a side to side transformation motion, in the second alternative embodiment shown in FIGS. 11A and 11B the toy vehicle 250 has a side to side transformation motion but does not have the up and down transformation motion of the original embodiment. This eliminates the need for transformation arms.

It will be obvious to those having skill in the art that many changes may be made to the details of the above-described embodiments of this invention without departing from the underlying principles thereof. The scope of the present invention should, therefore, be determined only by the following claims.

The invention claimed is:

1. A radio controlled toy vehicle having three or more wheels and controlled by a user operating a radio control transmitter comprising:

a left chassis body, a right chassis body, and a center chassis body, each of said chassis bodies having a front end, a rear end and a central portion;

a left main transformation arm attached to said left chassis body;

a right main transformation arm attached to said right chassis body;

a transformation drive including a transformation drive reversible electric motor, said transformation drive adapted to cause said left and right main transformation arms to move towards or away from each other when said transformation drive is actuated to thereby cause said left and right chassis bodies to move towards or away from each other, respectively, while maintaining the circular planes of said wheels perpendicular with a surface upon which they rest;

at least one of said wheels of said toy vehicle being driven by a wheel drive including a reversible electric wheel drive motor; and a radio control receiver mounted on one of said chassis bodies and adapted to individually actuate said transformation drive motor and said wheel drive motor upon receipt of a signal from said radio control transmitter.

2. The toy vehicle of claim 1 wherein said left and right main transformation arms are adapted cause said center chassis body to rise to a position above said left and right chassis bodies when said left and right chassis bodies are caused to move towards each other, and to cause said center chassis body to descend to a position between said left and right chassis bodies when said left and right chassis bodies are caused to move away from each other.

3. The toy vehicle of claim 1 wherein said left and right main transformation arms are adapted cause said center chassis body to move to a position behind said left and right chassis bodies when said left and right chassis bodies are caused to move towards each other, and to cause said center chassis body to move to a position between said left and right chassis bodies when said left and right chassis bodies are caused to move away from each other.

4. A radio controlled toy vehicle comprising:

a left chassis body, a right chassis body, and a center chassis body, each of said chassis bodies having a front end, a rear end and a central portion;

a left main transformation arm having an inner and outer edge, said main left transformation arm being pivotally attached along its outer edge to said left chassis body;

a right main transformation arm having an inner and outer edge, said right main transformation arm being pivotally attached along its outer edge to said right chassis body;

one of said left and right main transformation arms being pivotally attached to a main center pivot rod, the other of said left and right main transformation arms being mechanically interlocked to said main center pivot rod;

a transformation drive mounted within one of said left or right main transformation arms, said transformation drive including a reversible electric motor and associated drive train including reduction gears, said drive train being drivingly connected to said main center pivot rod and adapted to cause said left and right main transformation arms to rotate towards or away from each other when said transformation drive is actuated;

left and right driving wheels, left and right reversible electric wheel drive motors, said left and right reversible electric wheel drive motors having left and right drive trains that include left and right reduction gears and left and right drive shafts, said left and right reversible electric motors and associated drive trains being mounted adjacent the rear end of said left and right chassis bodies, respectively, said left and right driving wheels being mounted on said left and right drive shafts, respectively;

a radio control receiver and a battery mounted on one of said chassis bodies, and wiring electrically communicating said radio control receiver, said battery, said transformation drive electric motor, and said left and right electric motors to enable said radio control receiver to actuate said motors; and left and right front sliding wheels rotatably mounted adjacent the front ends of said left and right chassis, respectively.

5. The toy vehicle of claim 4 wherein said left main transformation arm is pivotally attached along its outer edge to a left pivot pin, said left pivot pin being attached to said left chassis body.

6. The toy vehicle of claim 4 wherein said right main transformation arm is pivotally attached along its outer edge to a right pivot pin, said right pivot pin being attached to said right chassis body.

7. The toy vehicle of claim 4 wherein said right or left main transformation arm not containing said transformation drive has a concave body adapted to receive said main transformation arm containing said transformation drive when said transformation motor is actuated to causes the main transformation arms to rotate towards each other.

8. The toy vehicle of claim 4 wherein said center chassis body is substantially positioned between said left and right chassis bodies when said main transformation arms are fully rotated away from each other, said center chassis being substantially positioned above said left and right chassis bodies when said transformation arms are rotated towards each other.

9. The toy vehicle of claim 4 wherein said radio control receiver is positioned within a receiver box mounted on said central chassis body at its rear end.

10. The toy vehicle of claim 9 including a rear wing attached to said receiver box.

11. The toy vehicle of claim 9 including a rear tilt wheel attached to said receiver box.

12. The toy vehicle of claim 4 including right and left side wings attached to said right and left main transformation arms, respectively.

13. The toy vehicle of claim 4 including a nose member attached to the front end of said center chassis.

14. The toy vehicle of claim 4 including a body figure attached to the center portion of said center chassis.

* * * * *